US009806477B2

(12) United States Patent
Riccardi

(10) Patent No.: US 9,806,477 B2
(45) Date of Patent: Oct. 31, 2017

(54) JACK FOR DATA AND TELECOMMUNICATION SYSTEM

(71) Applicant: Wilhelm Rutenbeck GmbH & Co. KG, Schalksmuehle (DE)

(72) Inventor: Oliver Riccardi, Schalksmuehle (DE)

(73) Assignee: WILHELM RUTENBECK GMBH & CO. KG, Schalksmuehle (DE)

( * ) Notice: Subject to any disclaimer, the term of this patent is extended or adjusted under 35 U.S.C. 154(b) by 0 days.

(21) Appl. No.: 15/409,584

(22) Filed: Jan. 19, 2017

(65) Prior Publication Data

US 2017/0214194 A1 Jul. 27, 2017

(30) Foreign Application Priority Data

Jan. 21, 2016 (DE) ..... 10 2016 101 039

(51) Int. Cl.
*H01R 24/64* (2011.01)
*H01R 107/00* (2006.01)

(52) U.S. Cl.
CPC ..... *H01R 24/64* (2013.01); *H01R 2107/00* (2013.01)

(58) Field of Classification Search
CPC ..... H01R 24/64; H01R 210/007
USPC ..... 439/676
See application file for complete search history.

(56) References Cited

U.S. PATENT DOCUMENTS 7,601,034 B1 * 10/2009 Aekins ..... H01R 13/6464 439/676
7,824,231 B2 * 11/2010 Marti ..... H01R 13/6466 439/676
7,837,513 B2 * 11/2010 Millette ..... H01R 13/6466 439/676
7,976,348 B2 * 7/2011 Aekins ..... H01R 13/6625 439/676
7,985,101 B2 * 7/2011 Fitzpatrick ..... H01R 13/64 439/676
8,128,436 B2 * 3/2012 Bopp ..... H01R 13/6658 439/676
8,425,255 B2 * 4/2013 Erickson ..... H01R 13/6464 439/620.22
8,641,452 B2 * 2/2014 Patel ..... H01R 13/6466 439/620.23
8,795,003 B2 * 8/2014 Mattson ..... H01R 13/641 439/676
8,998,650 B2 * 4/2015 Ku ..... H01R 24/64 439/676
9,379,501 B2 * 6/2016 Taylor ..... H04Q 1/13
(Continued)

*Primary Examiner* — Alexander Gilman
(74) *Attorney, Agent, or Firm* — Andrew Wilford

(57) ABSTRACT

A telecommunication or data-transmission jack has a dielectric housing forming a socket into which is insertable a plug having a plug body and plug contacts, a first circuit board carrying traces and fixed in the housing, connectors connected to the traces of the first circuit board, and a second flexible circuit board having a U-shaped outer end and an inner end. The outer end is provided with a plurality of outwardly exposed conductive strip contacts projecting into the socket and positioned in the socket to engage the plug contacts when the plug is fully inserted into the socket. The strip contacts are connected at the inner end of the second circuit board to the traces of the first circuit board. A dielectric support fitting complementarily within the U-shaped outer end of the second circuit board has respective fingers extending along and inwardly supporting the strip contacts.

5 Claims, 4 Drawing Sheets

(56) References Cited

U.S. PATENT DOCUMENTS

| | | | | |
|---|---|---|---|---|
| 9,413,124 | B2 * | 8/2016 | Riccardi | H01R 24/64 |
| 2005/0181676 | A1 * | 8/2005 | Caveney | H05K 1/0228<br>439/676 |
| 2007/0270044 | A1 * | 11/2007 | Belopolsky | H01R 27/00<br>439/676 |
| 2009/0029599 | A1 * | 1/2009 | Jaouen | H01R 24/64<br>439/676 |

* cited by examiner

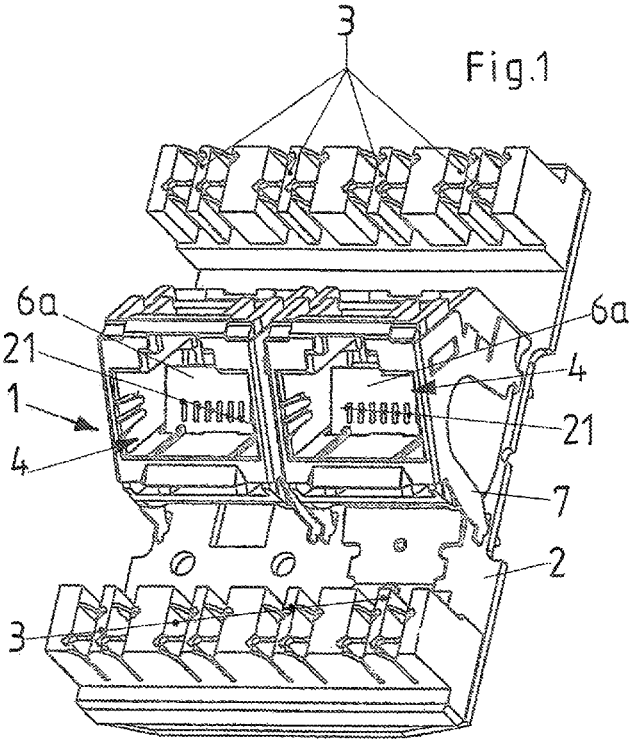
Fig.1
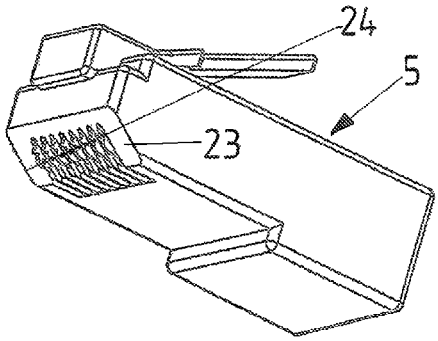
Fig.2 - Prior art
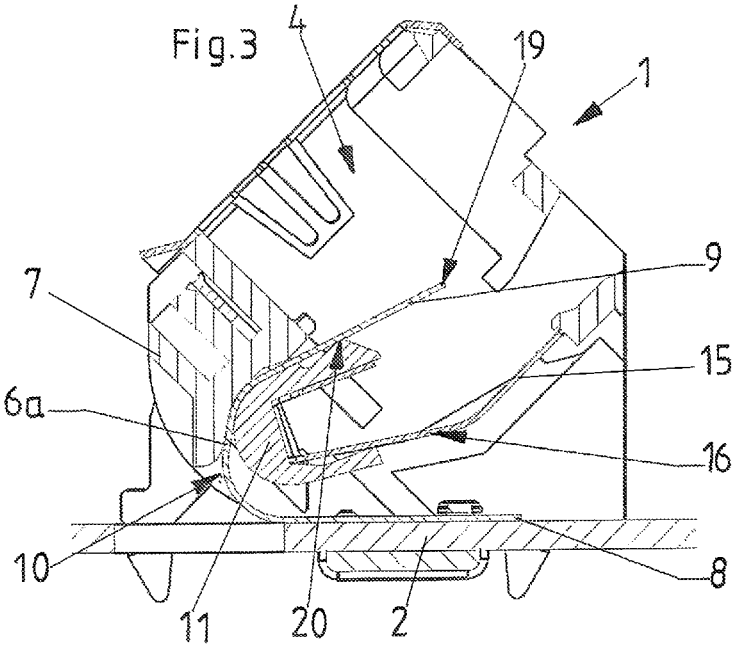
Fig.3

5
24
19
9
8
6a
20

5
24
19
9
8
11
6a
20
16

JACK FOR DATA AND TELECOMMUNICATION SYSTEM

FIELD OF THE INVENTION

The present invention relates to a jack. More particularly this invention concerns a keystone jack used for connection to a multiconductor data/telecommunications cable.

BACKGROUND OF THE INVENTION

As described in U.S. Pat. No. 9,413,124, a telecommunication or data-transmission jack has a housing and a first circuit board carrying traces and forming a lower face of the housing. Connectors connected to the traces of the first circuit board project from the first circuit board downward at the lower face. A dielectric housing part forms with the housing an upwardly open socket shaped to receive and fit with a substantially complementary telecommunication or data-transmission plug. A second flexible circuit board has a U-shaped outer end formed with a plurality of conductive jack fingers projecting into the socket and positioned in the socket to engage respective contacts of the plug when the plug is fitted in the socket. These jack fingers are connected at an inner end of the second circuit board to the traces of the first circuit board. A U-shaped dielectric support fits complementarily within the U-shaped end of the second circuit board and has fingers extending along the jack fingers and fixed thereto. The fingers of the jack and of the support are pivotal in the part between an inner position with the jack fingers spaced from an open end of the socket and an outer position between the inner position and the open end of the socket. A U-shaped leaf spring fits within the support, has fingers extending along the support fingers and bearing outwardly thereon, and is braced against the part to bias the jack fingers into the outer position.

In this approach, it has proven advantageous for the second end of the circuit board to be bent by more than 180°, and on the end to have short finger-like separate strip contacts parallel to one another. A type of comb structure is thus formed in which the strip contacts form the teeth of the comb. As a result, the contact points on these strip contacts are close to the first end. Furthermore, it has proven advantageous for the separate strip contacts to be fixed to fingers of arcuate support in order to thus prevent relative movement between the support and the separate strip contacts, and resulting wear.

In addition, providing a leaf spring, which likewise merges into separate elastic fingers at the second end via a bend and is fastened between a housing part and the further component of the contact support, allows on the one hand long-lasting resiliency of the separate strip contacts, and on the other hand a reduction in the wear on the contact points.

This type of jack already has excellent transmission properties that also correspond to so-called Category 8, and has proven successful as a sustainable solution with a long service life.

OBJECTS OF THE INVENTION

It is therefore an object of the present invention to provide an improved jack for a data and telecommunication system.

Another object is the provision of such an improved jack for a data and telecommunication system that overcomes the above-given disadvantages, in particular with an improved number of possible insertion operations of a plug, and at the same time improved transmission properties of electrical signals and the like.

SUMMARY OF THE INVENTION

A telecommunication or data-transmission jack has according to the invention a dielectric housing forming a socket into which is insertable a plug having a plug body and plug contacts, a first circuit board carrying traces and fixed in the housing, connectors connected to the traces of the first circuit board, and a second flexible circuit board having a U-shaped outer end and an inner end. The outer end is provided with a plurality of outwardly exposed conductive strip contacts projecting into the socket and positioned in the socket to engage the plug contacts when the plug is fully inserted into the socket. The strip contacts are connected at the inner end of the second circuit board to the traces of the first circuit board. A dielectric support fitting complementarily within the U-shaped outer end of the second circuit board has respective fingers extending along and inwardly supporting the strip contacts and each formed with an outwardly projecting bump. The outer end of the second flexible circuit board has an end part projecting from the fingers past the support into the socket such that, on insertion of the jack into the socket, the body of the jack engages the end part and pivotally bends the strip contacts about the respective bumps into an inner position from an outer position between the inner position and an open end of the socket. A U-shaped leaf spring fitting within the support has fingers extending along the support fingers and bearing outwardly thereon, and is braced against the housing to bias the strip contacts into the outer position.

A cutout or recess is provided between every two successive strip contacts. That is, the end part projecting beyond the strip contacts is provided at the end of the strip contacts opposite from the second circuit board.

For transmitting electrical signals according to the Category 8 standard, a standardized RJ45 plug is inserted into the jack. Upon insertion into the jack, in an intermediate position, i.e. a position in which the plug has already been partially inserted into the jack but has not yet reached the end position, i.e. the locking and contact position, the body of the plug initially engages the end part projecting beyond the strip contacts. When the plug is inserted into the jack, the plug subsequently exerts pressure on the end part and pivots this part toward the first end of the second circuit board. In the locking and contact position, the second end of the second circuit board is in a free space between the first end of the leaf spring and the plug.

Wear on the strip contacts forming the contact points between the plug and the jack during frequent insertion of the plug into the jack is reduced by the pivoting of this end part projecting beyond the strip contacts. The pivoting of the end part, projecting beyond the strip contacts, around the bump of the support on the one hand ensures that corresponding strip contacts, namely, the strip contacts, are not damaged by sharp-edged portions of the plug or the contacts of the plug, and on the other hand allows subsequent interruption-free contacting with the plug in the contact position of the plug.

These portions of the plug that initially engage the end part projecting beyond the strip contacts often have sharp edges that could possibly damage the strip contacts, in particular for a large number of plug-in operations that would limit the electrical conductivity of the strip contacts and possibly damage the connection between the plug and the jack. This possible damage and resulting impairment are avoided in that the sharp edges of the plug body initially engage the end part projecting from the strip contacts and pivot it when the plug is inserted into the jack. Subsequently, when the end position of the plug, i.e., the locking and contact position of the plug, is reached, the strip contacts are supported against the force of the spring and held by the particular fingers of the support in a position pressed against the contacts of the plug. This ensures transmission of electrical signals from the plug to the jack and from the jack back to the plug that is reliable and durable over the long term, and that is also ensured for a large number of plug-in operations.

The strip contacts are components of the particular second circuit board, and are freed of insulation only in the region and at the side where they engage the inserted plug contacts. All regions of the second circuit board that do not make contact with portions of the plug may be provided with insulation.

A jack of this type allows a particularly large number of plug-in operations of a plug in question. That is, even for a large number, for example far more than 750 plug-in operations, such a jack has proven to be reliable, and even with the large number of plug-in operations there is no limitation in the transmission of electrical signals between the strip contacts and the contacts of an inserted plug.

In addition, a latch, for example a ratchet tooth, that is on the insertion region forward of the first and the eighth finger-like strip conductor section may be provided in a manner known per se, thus preventing damage to such a jack due to insertion of an impermissible plug, for example an RJ11 or RJ12 plug.

In another independently inventive jack of the type mentioned above, the strip contacts are exposed on the side of the second circuit board facing the contacts of the plug.

In a second circuit board of this type, the strip contacts that form the contact points are formed by strip contacts that are exposed on the second circuit board. That is, only the regions that contact the contacts of the plug when a plug is inserted into the jack are freed of insulation and thus electrically conductive. The region of the second circuit board surrounding the strip contacts is not electrically conductive, for example due to coating with an insulating layer. Thus, in this approach, the contact fingers of the strip contacts are an integral part of the circuit board, and are exposed only in the region that contacts the contacts of the plug when the plug is inserted.

In this approach, no recesses are provided between two adjacently situated strip contacts.

Particularly efficient transmission of electrical signals is thus possible, at the same time with only very little interference from external influences. The regions between two parallel finger-like strip contacts are formed by portions of the second strip conductor that are provided with an insulation material, so that no electrical signals can be transmitted from a first finger-like strip conductor section to a second finger-like strip conductor section.

In both described jacks according to the invention, it may particularly preferably be provided that the strip contacts are surrounded or adjoined by electrotechnical compensation means, resonance damping means, and/or additional or other means that improve the electrical transmission properties, these means being situated, at least partially, in the end part projecting beyond the strip contacts.

The provision of electrotechnical compensation means is known per se. However, in the approaches known in the prior art, such compensation means are at or near the first end of the second circuit board. This means that there is a long path, and thus a great distance, from the compensation means to the strip contacts. As a result of the compensation means being near or in the immediate vicinity of the strip contacts, a significant improvement of the effect, for example the resonance damping or the shielding of the strip contacts or strip contacts that form a contact point, is made possible. In addition, the transmission of electrical signals is thus improved compared to known approaches, and in particular the susceptibility to sources of interference is reduced.

In all approaches, the regions that are in contact with the contacts of the plug, i.e. the strip contacts, may be provided with a coating that ensures the electrical conductivity over the long term, and at the same time protects from corrosion. For example, a layer of gold, which ensures long-lasting operation with high electrical conductivity, is provided for this purpose.

In addition, the second circuit board has eight adjoining strip contacts. Such a design is used for inserting plugs, for example standardized RJ45 plugs that have eight contacts for four pairs of conductors.

Last, the second circuit board is made of a flexible film as a base support. Use of a flexible film as a base support on which the various strip contacts and additional electrotechnical compensation means are situated, allows particularly flexible adaptation of the strip contacts, namely, the strip contacts, to the regions that are to be contacted, of the plug that is inserted into the jack. Here as well, a particularly large number of plug-in operations, in particular of a standardized RJ45 plug, into the jack is thus made possible without the portions of the jack that transmit the electrical signals being damaged, thus impairing the transmission of the electrical signals.

BRIEF DESCRIPTION OF THE DRAWING

The above and other objects, features, and advantages will become more readily apparent from the following description, reference being made to the accompanying drawing in which:

FIG. 1 is a perspective view of a dual jack according to the invention;

FIG. 2 shows a standard RJ45 plug usable with the invention;

FIG. 3 is a side sectional view through the jack in a starting or rest position before insertion of a plug;

SPECIFIC DESCRIPTION OF THE INVENTION

Figure 4:
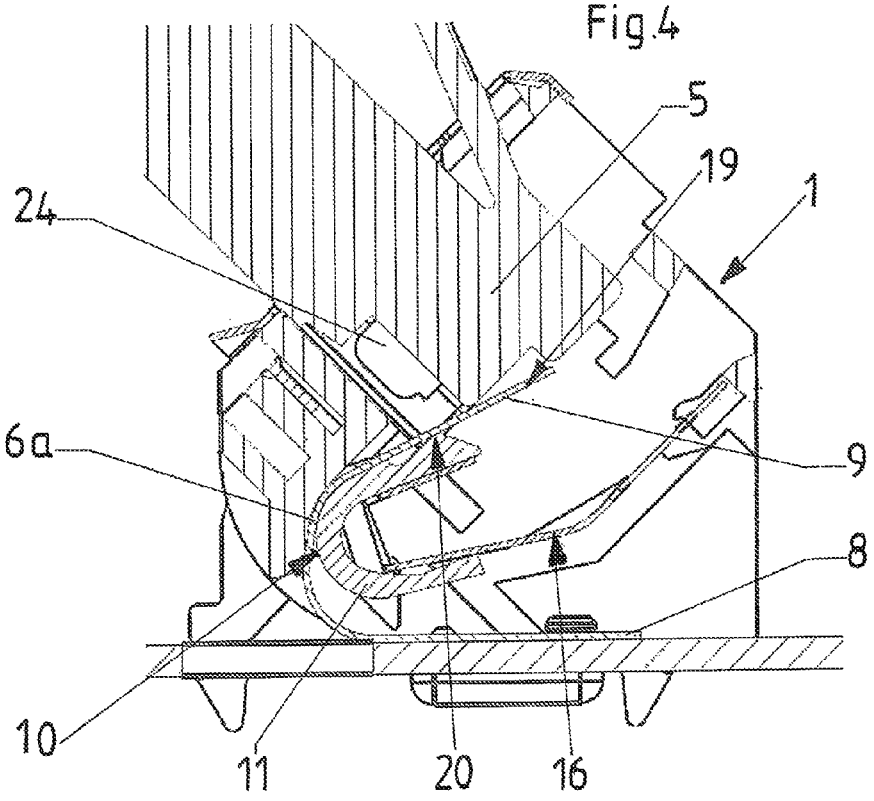
FIG. 4 is a view like FIG. 3 but with an inserted plug in a first intermediate position prior to touching the second circuit board.
Figure 5:
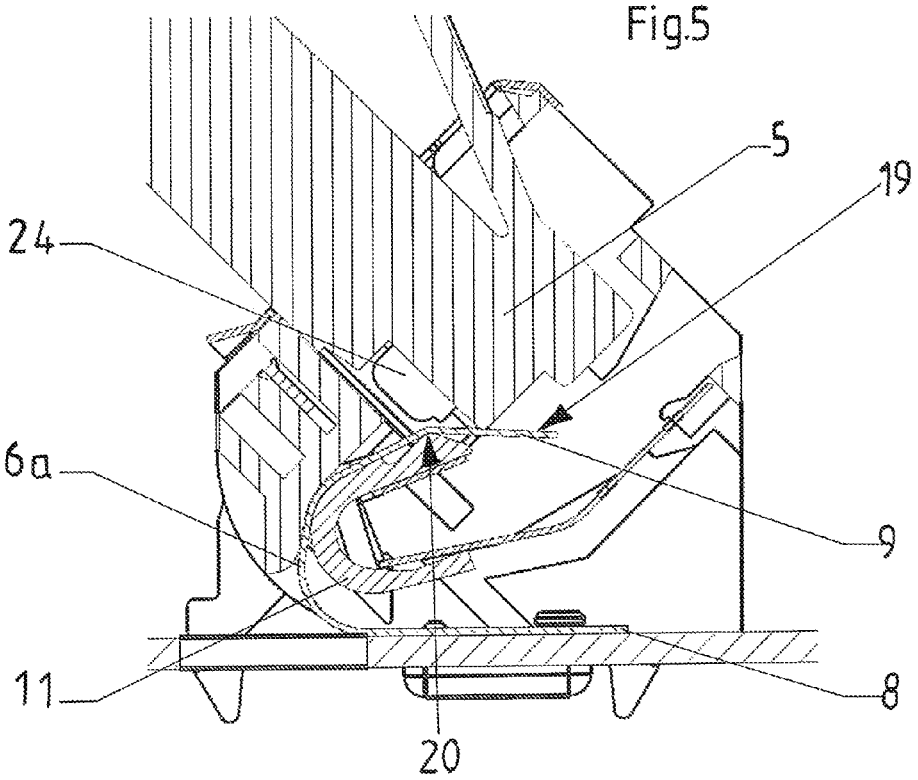
FIG. 5 is another view like FIG. 3 but with the plug in another intermediate position in which it pivots a part of the circuit board.
Figure 6:
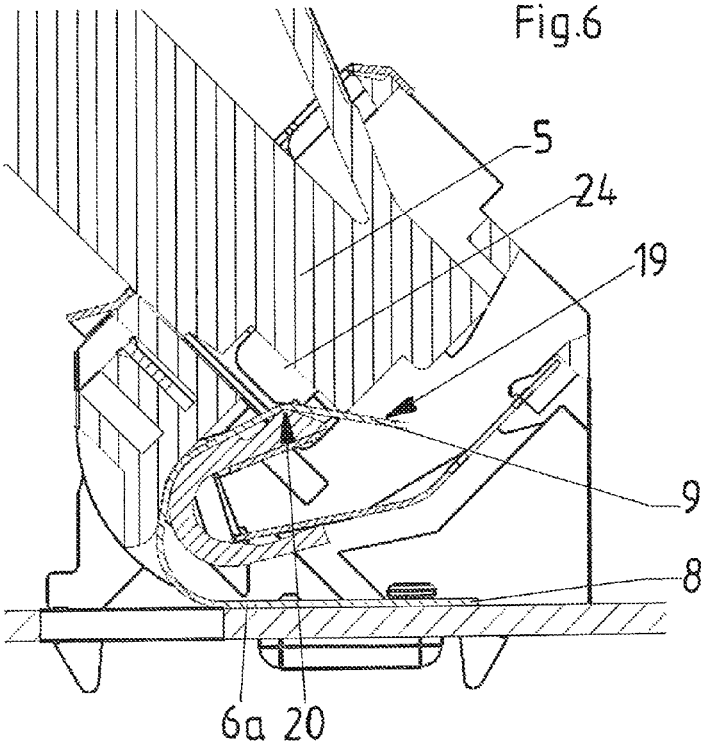
FIG. 6 is another view like FIG. 3 but with the plug body making first contact with the contacts of the socket.
Figure 7:
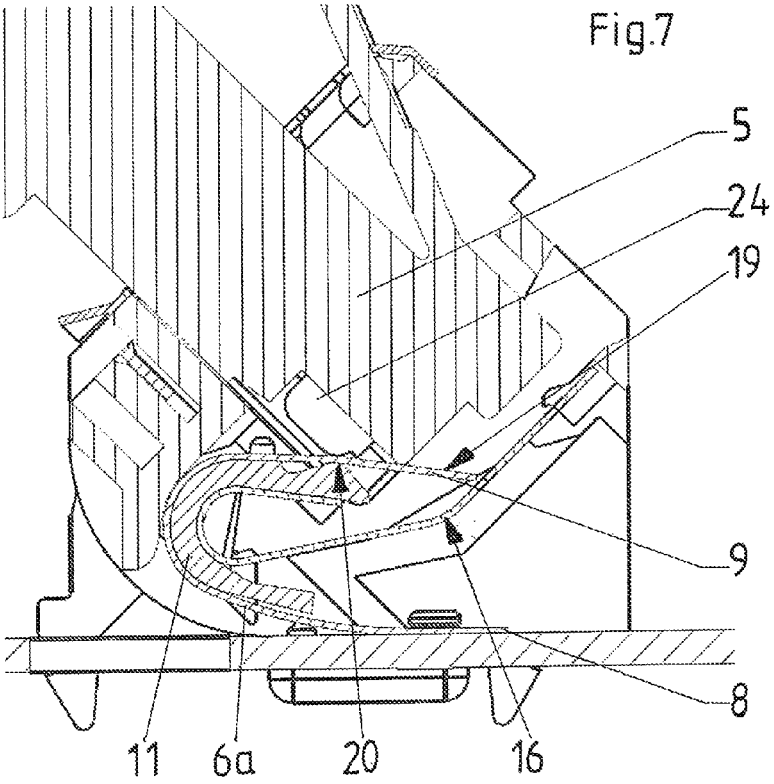
FIG. 7 is another view like FIG. 3 but with the plug in the end locking and contact position.

As seen in FIG. 1 a double jack 1 for a telecommunication or data-transmission system has a first rigid circuit board 2 with four pairs of connectors 3 for respective electrical conductors. The double jack 1 may also be designed as a single jack. The double jack 1 has a housing 7 carries the board 2 and connectors 3. In this embodiment, the connectors 3 are accessible from a front side of the housing 7 that is typically closed by an unillustrated removable cover. The dielectric housing 7 is formed with two sockets 4 for RJ45 plugs 5 to be connected with the jack 1. FIG. 2 shows this plug 5 and its eight plug contacts 24 exposed at a beveled end face 23.

The jack 1 also has a second but flexible circuit board 6*a* carrying eight strip contacts 21 engageable with the plug contacts 24. The second flexible circuit board 6*a* is fixed to the first circuit board 2, and its strip contacts 21 engage unillustrated traces on the board 1 and, through them, are connected with the connectors 3. The strip contacts 21 are elastically supported by a spring 16 (FIG. 9) and a support 11 (FIG. 10) mounted in the jack 1. The flexible second circuit board 6*a* has a first end 8 secured to the first circuit board 2.

As is apparent in particular from FIGS. 3-7 and FIGS. 9-11, a second end 9 of each circuit board 6*a* is bent by more than 180° to impart a U-shape to the flexible board 6*a*, and has the short strip contacts 21 (according to FIG. 11) extending parallel to one another. These strip contacts 21 are exposed in the socket 4. The second end 9 of the second circuit board 6*a* is supported at the separate strip contacts 21 and at a portion of a bend 10 connecting the ends 8 and 9 by an arcuate support 11 made of insulation material.

This arcuate support 11 has freely projecting fingers 12 that each are adapted to engage a respective one of the separate strip contacts 21. Thus these separate strip contacts 21 rest on the fingers 12 and are optionally fixed thereto. The support 11 is held with limited pivotability in a seat in the housing 7, and the housing 7 surrounds and supports, at least partially, the region of the bend 10 on the surface facing away from the support 11. In addition, the support 11 bears against the inner face of the first end 8 of the second circuit board 6*a* that itself is secured to the first circuit board 2.

Figure 9:
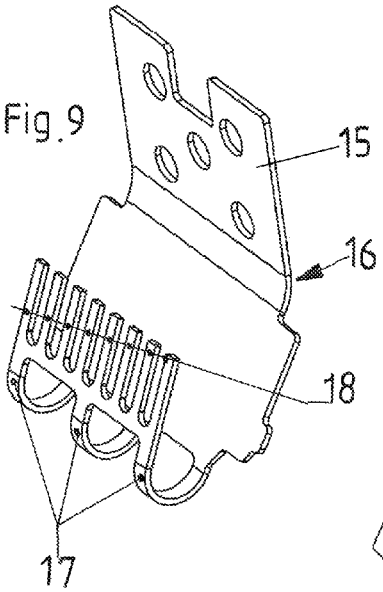
FIG. 9 is a perspective view of a leaf spring of this invention.
Figure 10:
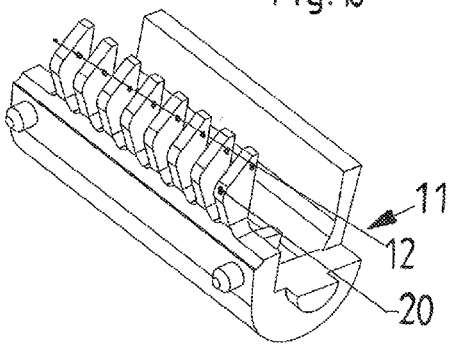
FIG. 10 is a perspective view of a support according to the invention.

As is apparent from FIGS. 3 to 7, a first end 15 of a leaf spring 16 is secured to the housing 7. As shown in FIG. 9, the leaf spring 16 merges into separate elastic fingers 18 at the second end via a bend 17. The separate elastic fingers 18 each are engageable with a respective one fingers 12 in a direction away from the separate strip contacts 21.

According to the invention, the second circuit board 6*a* has an end part 19 that projects beyond the strip contacts 21. In addition, each support finger has a bump 20 that projects toward the respective strip contact 21. When the plug 5 is inserted into the socket 4 of the jack 1, in an intermediate position prior to reaching the contact position, the body of the plug 5 engages the end parts 19 project beyond the strip contacts 21. In the process, the bump 20 forms a pivot axis for this end part 19 so it is pivoted around this bump 20 by the plug 5. In an further intermediate position of the plug 5 inserted into the socket 4, in which the contacts of the plug 5 and the strip contacts 21 are not yet in contact, and in the contact position of the plug 5 inserted into the socket 4, the end part 19 projecting beyond the strip contacts 21 is pivoted around the bump 20 that forms an abutment, toward the fixed first end 8 of the second circuit board 6.

As the result of portions of the plug 5 initially engaging the end part 19 projecting beyond the strip contacts 21 when the plug 5 is inserted into the socket 4, damage to the strip contacts 21 that form the actual contact point is largely avoided. The portions of the plug 5 that make contact often have a sharp-edge design that may result in damage to the portions of the second circuit board 6*a* that initially come into contact with these portions.

This type of jack 1 according to the invention thus allows a large number of plug-in operations of a plug 5. Even a large number of more than 750 plug-in operations may be carried out without damage to such a jack 1, for example due to sharp-edges of the plug 5.

The number of damage-free plug-in operations for such a jack 1 is thus significantly increased, and a long service life is made possible.

Figure 11:
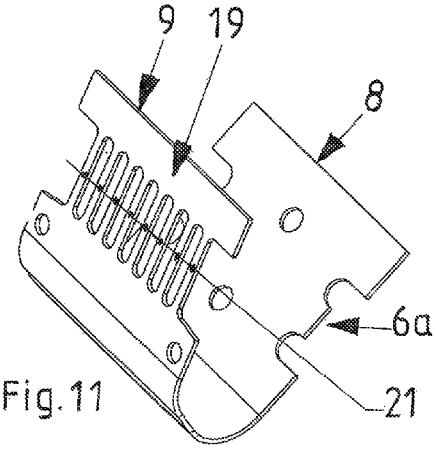
FIG. 11 is a perspective view of the second circuit board according to the invention.

In the second circuit board 6*a* described above, which is illustrated as an individual part in FIG. 11, the region between two successive strip contacts 21 is cut away.

In this embodiment, the second circuit board 6*a* shown in FIG. 11 is also made of a flexible film, and is extended beyond the strip contacts 21 at the end part 19. The entire extended end part 19, with the exception of the strip contacts 21 that form the contact point, may be provided with a layer of insulation material.

Figure 8:
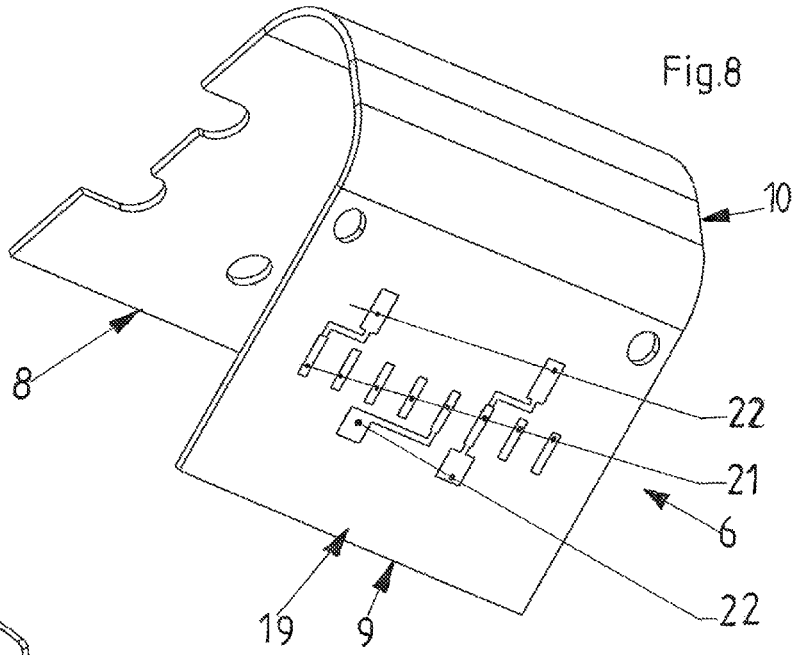
FIG. 8 is a perspective top view of a variant circuit board according to the invention.

In one alternative or additional embodiment shown in FIG. 8 and that is also regarded as independently inventive, the strip contacts 21 are formed on a face of the second circuit board 6 facing the contacts of the plug 5. In this embodiment of a second circuit board 6, not only is the board 6 extended beyond and between the strip contacts 21, but the strip contacts 21 are also an integral part of the circuit board 6*a*, and are freed of insulation only for electrical contacting, i.e. for transmission of electrical signals, on the second circuit board 6. The surface remaining between two adjacent strip contacts 21 is not cut away, but instead is filled by the second circuit board 6*a*, made, for example, of a flexible film with a dielectric cover layer. Otherwise the board 6 is the same as the board 6*a* described above.

As is further apparent from FIG. 8, the strip contacts 21 of the second circuit board 6 may be surrounded or directly adjoined by electrotechnical compensation means 22 schematically illustrated in FIG. 8. These electrotechnical compensation means 22 may comprise resonance damping means, means that increase the shielding, or additional or other means that improve the electrical transmission properties. In this regard, it is particularly advantageous that the compensation means 22 may be particularly close to the strip contacts 21. The arrangement may be provided in the end part 19 projecting beyond the strip contacts 21, or in an end part near the other side of the strip contacts 21.

Due to the close arrangement, in particular the compensation may be improved, and, for example, shielded separation may be situated close to strip contacts 21 that form the contact surfaces, in a much easier, more effective manner.

As is apparent in particular from FIGS. 8 and 11, the second circuit board 6 or 6*a* has eight adjacently situated strip contacts 21. This is known per se, and is provided to allow use of a corresponding standardized RJ45 plugs.

In these embodiments, the second circuit boards 6 and 6*a* are each made of a flexible film as a base support layer. Height differences of the individual plug-in plug contacts 24 may be compensated for in a particularly easy manner during contacting by the use of a flexible film. Since the individual strip contacts 21 are pressed against the contacts 24 of the plug 5 the elastic fingers 18 of the leaf spring 16 and the fingers 12 of the support 11, compensation for height in the event of height differences of the individual plug-in plug contacts 24 is easily made possible.

The invention is not limited to this embodiments, and may be varied in numerous ways within the scope of the disclosure. All single and combined features disclosed in the description and/or drawings are regarded as essential to the invention.

I claim:

1. A telecommunication or data-transmission jack comprising:

a dielectric housing forming a socket into which is insertable a plug having a plug body and plug contacts;

a first circuit board carrying traces and fixed in the housing;

connectors connected to the traces of the first circuit board;

a second flexible circuit board having a U-shaped outer end and an inner end, the outer end being provided with a plurality of outwardly exposed conductive strip contacts projecting into the socket and positioned in the socket to engage the plug contacts when the plug is fully inserted into the socket, the strip contacts being connected at the inner end of the second circuit board to the traces of the first circuit board;

a dielectric support fitting complementarily within the U-shaped outer end of the second circuit board, having respective fingers extending along and inwardly supporting the strip contacts and each formed with an outwardly projecting bump, the outer end of the second flexible circuit board having an end part projecting from the fingers past the support into the socket such that, on insertion of the jack into the socket, the body of the jack engages the end part and pivotally bends the strip contacts about the respective bumps into an inner position from an outer position, the outer position being between the inner position and an open end of the socket; and a U-shaped leaf spring fitting within the support, having fingers extending along the support fingers and bearing outwardly thereon, and braced against the housing to bias the strip contacts into the outer position.

2. The jack defined in claim 1, wherein the strip contacts are formed exposed on a face of the second circuit board facing the contacts of the plug.

3. The jack defined in claim 1 wherein, the strip contacts are surrounded or adjoined by electrotechnical compensation means, resonance damping means, or additional or other means that improve electrical transmission properties and that at least partially provided on the end part projecting beyond the strip contacts.

4. The jack defined in claim 1, wherein the second circuit board has eight of the strip contacts.

5. The jack defined in claim 1, wherein the second circuit board is made of a flexible film as a base support.

* * * * *